US008893794B2

(12) United States Patent
Patel

(10) Patent No.: US 8,893,794 B2
(45) Date of Patent: Nov. 25, 2014

(54) INTEGRATED ZONAL CONTACT AND INTELLIGENT COMPLETION SYSTEM

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 359 days.

(21) Appl. No.: 13/396,269

(22) Filed: Feb. 14, 2012

(65) Prior Publication Data

US 2012/0325484 A1 Dec. 27, 2012

Related U.S. Application Data

(60) Provisional application No. 61/443,461, filed on Feb. 16, 2011.

(51) Int. Cl.

| | |
|---|---|
| ***E21B 34/14*** | (2006.01) |
| ***E21B 43/26*** | (2006.01) |
| ***E21B 43/14*** | (2006.01) |

(52) U.S. Cl.

CPC ..... *E21B 43/14* (2013.01); *E21B 34/14* (2013.01); *E21B 43/26* (2013.01)

USPC ..... 166/308.1; 166/373; 166/177.5; 166/332.1; 166/334.4

(58) Field of Classification Search

CPC ..... E21B 34/14; E21B 43/162; E21B 43/114

USPC ..... 166/373, 332.1, 332.8, 334.4, 242.7, 166/313, 177.5, 250.1, 308.1

See application file for complete search history.

(56) References Cited

U.S. PATENT DOCUMENTS

| | | | | |
|---|---|---|---|---|
| 3,768,556 | A | 10/1973 | Baker | |
| 3,789,926 | A | 2/1974 | Henley et al. | |
| 4,991,653 | A | 2/1991 | Schwegmen | |
| 4,991,654 | A | 2/1991 | Brandell | |
| 5,810,087 | A | 9/1998 | Patel | |
| 5,950,733 | A | 9/1999 | Patel | |
| 6,085,845 | A | 7/2000 | Patel et al. | |
| 6,227,298 | B1 | 5/2001 | Patel | |
| 6,250,383 | B1 | 6/2001 | Patel | |
| 6,354,378 | B1 | 3/2002 | Patel | |
| 6,776,238 | B2 | 8/2004 | Dusterhoft et al. | |
| 6,782,948 | B2 * | 8/2004 | Echols et al. | 166/278 |
| 7,066,265 | B2 * | 6/2006 | Surjaatmadja | 166/308.1 |
| 7,108,067 | B2 | 9/2006 | Themig et al. | |
| 7,243,723 | B2 * | 7/2007 | Surjaatmadja et al. | 166/278 |
| 7,267,172 | B2 | 9/2007 | Hofman | |
| 7,347,272 | B2 | 3/2008 | Patel et al. | |
| 7,387,165 | B2 | 6/2008 | Lopez de Cardenas | |
| 7,431,091 | B2 | 10/2008 | Themig et al. | |

(Continued)

*Primary Examiner* — Kenneth L Thompson

(74) *Attorney, Agent, or Firm* — Patrick A. Traister; Brandon S. Clark

(57) ABSTRACT

Systems and methods for producing from multiple zones in a subterranean formation are provided. The system can include a liner including a first frac valve, a second frac valve, and a formation isolation valve. The second frac valve can be positioned above the first frac valve, and the formation isolation valve can be positioned above the second frac valve. A completion assembly can be disposed at least partially within the liner. The completion assembly can include a valve shifting tool adapted to actuate the formation isolation valve between an open position and a closed position. The completion assembly can also include a first flow control valve in fluid communication with the first frac valve and a second flow control valve in fluid communication with the second frac valve.

19 Claims, 10 Drawing Sheets

(56) References Cited

U.S. PATENT DOCUMENTS

| | | | | |
|---|---|---|---|---|
| 7,591,312 | B2 * | 9/2009 | Johnson et al. | 166/278 |
| 7,604,055 | B2 * | 10/2009 | Richard et al. | 166/308.1 |
| 7,617,876 | B2 | 11/2009 | Patel et al. | |
| 7,673,673 | B2 * | 3/2010 | Surjaatmadja et al. | 166/55 |
| 7,802,627 | B2 * | 9/2010 | Hofman et al. | 166/386 |
| 7,980,316 | B2 | 7/2011 | Swenson et al. | |
| 8,490,704 | B2 * | 7/2013 | Caro et al. | 166/308.1 |
| 2002/0104650 | A1 * | 8/2002 | Dusterhoft et al. | 166/227 |
| 2003/0051876 | A1 | 3/2003 | Tolman et al. | |
| 2003/0150622 | A1 | 8/2003 | Patel et al. | |
| 2007/0204995 | A1 * | 9/2007 | Hofman et al. | 166/308.1 |
| 2007/0272411 | A1 | 11/2007 | Lopez de Cardenas | |
| 2008/0179060 | A1 * | 7/2008 | Surjaatmadja et al. | 166/298 |
| 2009/0044944 | A1 | 2/2009 | Murray et al. | |
| 2009/0078427 | A1 | 3/2009 | Patel | |
| 2009/0084553 | A1 | 4/2009 | Rytlewski et al. | |
| 2009/0211755 | A1 | 8/2009 | Dyer et al. | |
| 2009/0294123 | A1 * | 12/2009 | Mescall et al. | 166/250.01 |
| 2010/0108323 | A1 * | 5/2010 | Wilkin | 166/373 |
| 2011/0056692 | A1 | 3/2011 | Lopez de Cardenas | |
| 2011/0120726 | A1 * | 5/2011 | Murray et al. | 166/373 |
| 2012/0048559 | A1 | 3/2012 | Ganguly et al. | |
| 2012/0080190 | A1 | 4/2012 | Rytlewski | |
| 2013/0075109 | A1 * | 3/2013 | Frisby et al. | 166/373 |
| 2014/0083682 | A1 * | 3/2014 | Grigsby et al. | 166/250.01 |

* cited by examiner

INTEGRATED ZONAL CONTACT AND INTELLIGENT COMPLETION SYSTEM

CROSS-REFERENCE TO RELATED APPLICATIONS

This application claims the benefit of and priority to U.S. provisional patent application having Ser. No. 61/443,461 that was filed on Feb. 16, 2011, the entirety of which is incorporated by reference herein in its entirety.

BACKGROUND

Embodiments described herein generally relate to a liner assembly for use in a wellbore. More particularly, the embodiments relate to a liner assembly having a lower completion assembly disposed at least partially therein.

Single trip, multi-zone liners are placed inside cased and perforated wellbores, and used to fracture multiple zones in the surrounding subterranean formation. However, due to the relatively small internal diameter of such conventional liners, it is difficult to position a completion assembly therein.

To fit a completion assembly within a conventional liner, one solution has been to reduce the internal diameter of the completion assembly. Reducing the internal diameter of the completion assembly, however, reduces the rate at which fluids, e.g., hydrocarbons, can be produced.

What is needed, therefore, is an improved liner assembly and completion assembly.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

Systems and methods for producing from multiple zones in a subterranean formation are provided. In one aspect, the system can include a liner including a first frac valve, a second frac valve, and a formation isolation valve. The second frac valve can be positioned above the first frac valve, and the formation isolation valve can be positioned above the second frac valve. A completion assembly can be disposed at least partially within the liner. The completion assembly can include a valve shifting tool adapted to actuate the formation isolation valve between an open position and a closed position. The completion assembly can also include a first flow control valve in fluid communication with the first frac valve and a second flow control valve in fluid communication with the second frac valve.

In one aspect, the method can include running a liner into a wellbore. The liner can include a formation isolation valve, a first frac valve, and a second frac valve. The first frac valve can be disposed adjacent a first zone, the second frac valve can be disposed adjacent a second zone, and the formation isolation valve can be disposed above the first and second frac valves. The first and second zones can then be fractured. A lower completion assembly can be positioned at least partially within the liner. The lower completion assembly can include a first flow control valve in fluid communication with the first frac valve and a second flow control valve in fluid communication with the second frac valve. An upper completion assembly can then be positioned in the wellbore above the lower completion assembly. The first and second flow control valves can be opened, and a first fluid can flow from the first zone through the first frac valve and the first flow control valve and into an inner bore of the lower completion assembly. Likewise, a second fluid can flow from the second zone through the second frac valve and the second flow control valve and into the inner bore of the lower completion assembly.

BRIEF DESCRIPTION OF THE DRAWINGS

So that the recited features can be understood in detail, a more particular description, briefly summarized above, can be had by reference to one or more embodiments, some of which are illustrated in the appended drawings. It is to be noted, however, that the appended drawings illustrate only typical embodiments and are therefore not to be considered limiting of its scope, for the invention can admit to other equally effective embodiments.

DETAILED DESCRIPTION

Figure 1:
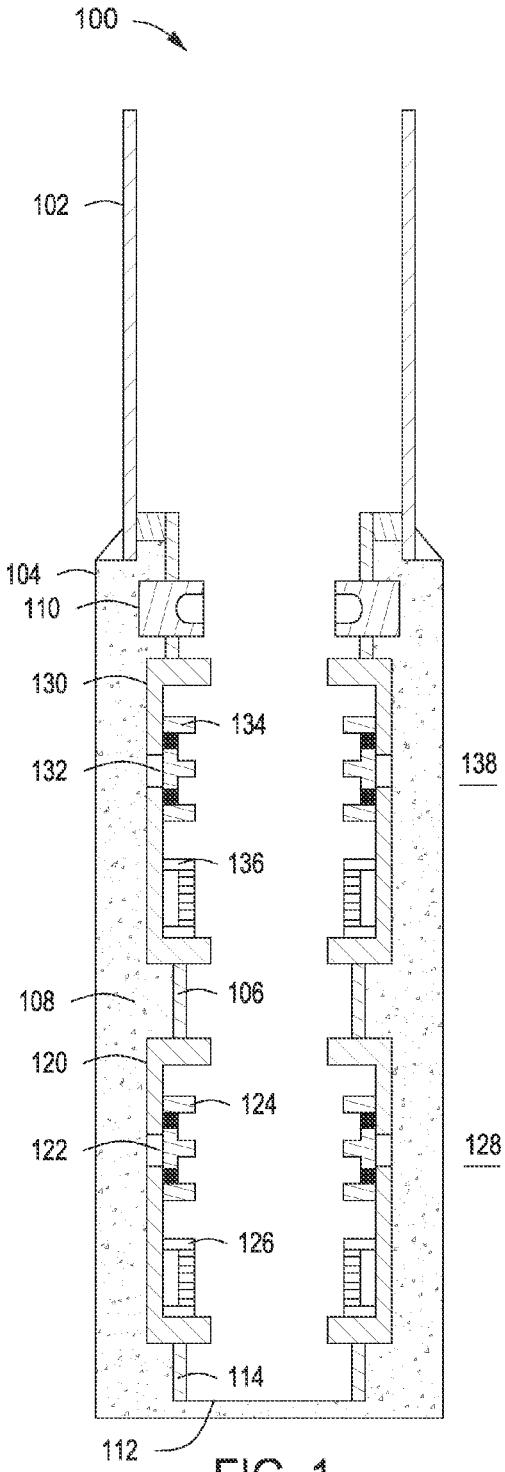
FIG. 1 depicts a cross-sectional view of a liner assembly cemented in place in a wellbore, according to one or more embodiments described.

FIG. 1 depicts a cross-sectional view of a liner assembly 106 cemented in place in a wellbore 100, according to one or more embodiments. The wellbore 100 can include an upper section that includes a casing 102 and a lower section that can be cased or uncased. For example, the lower section can be uncased. The liner assembly 106 can be disposed at least partially within the uncased section and radially inward from a wellbore wall 104. The liner assembly 106 can include one or more formation isolation valves (one is shown) 110 and one or more frac valves (two are shown) 120, 130. The formation isolation valve 110 and/or the frac valves 120, 130 can be coupled to or integral with the liner assembly 106.

The formation isolation valve 110 (also known as a fluid loss control valve) can be actuated between an open position where fluid is allowed to flow axially through the liner 106 and a closed position where fluid is prevented from flowing axially through the liner 106. The formation isolation valve 100 can be actuated mechanically, electrically, or hydraulically. In at least one embodiment, the formation isolation valve 100 can be disposed above the frac valves 120, 130 in the liner 106. The wellbore 100 can be a vertical, horizontal, or deviated wellbore. Thus, as used herein, "above" includes a position that is closer to the wellhead (not shown), and "below" includes a position that is farther from the wellhead.

The first, lower frac valve 120 can include one or more radial ports 122, one or more sliding sleeves 124, and one or more screens 126. Likewise, the second, upper frac valve 130 can include one or more radial ports 132, one or more sliding sleeves 134, and one or more screens 136. The ports 122, 132 can be formed radially through the frac valves 120, 130 and be circumferentially and/or axially offset on the frac valves 120, 130. The sleeves 124, 134 can be positioned above the screens 126, 136 in the frac valves 120, 130, as shown, or the sleeves 124, 134 can be positioned below the screens 126, 136.

The first frac valve 120 can be positioned adjacent a first, lower zone 128 in the subterranean formation, and the second frac valve 130 can be positioned adjacent a second, upper zone 138 in the subterranean formation. In at least one embodiment, the first frac valve 120 can include a plurality of frac valves axially offset from one another and positioned adjacent the first zone 128. Likewise, the second frac valve 130 can include a plurality of frac valves axially offset from one another and positioned adjacent the second zone 138.

The frac valves 120, 130 shown in FIG. 1 are in a first, closed position such that the sleeves 124, 134 are positioned axially-adjacent to the ports 122, 132 and prevent fluid flow through the ports 122, 132, i.e., between the inside of the liner 106 and the annulus 108 or the first and second zones 128, 138. When in the first position, a work string or service tool (not shown) can be lowered into the wellbore 100, and an end of the work string can stab into and seal with a float collar or formation isolation valve 112 proximate the lower end 114 of the liner 106. Once a seal is formed, cement can be pumped downward through the work string and flow upward into the annulus 108 between the casing 104 and the liner 106. Thus, the liner 106, including the formation isolation valve 110 and the frac valves 120, 130, can be cemented into place in the wellbore 100. The cement can provide zonal isolation between the first and second zones 128, 138.

Figure 2:
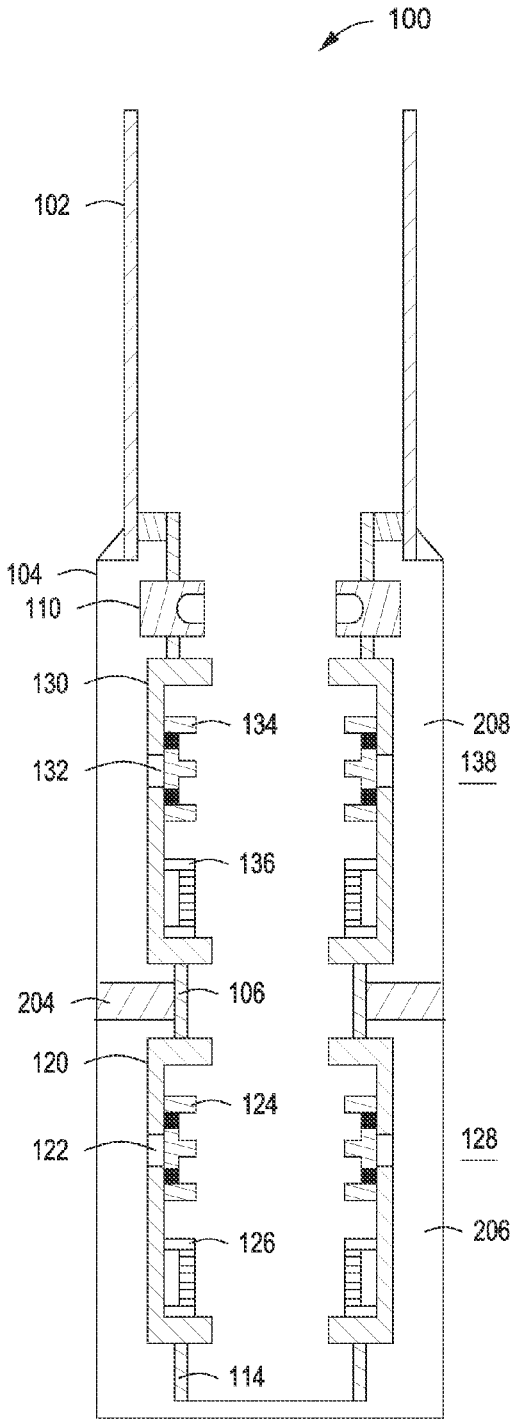
FIG. 2 depicts another cross-sectional view of the liner assembly in the wellbore, according to one or more embodiments described.

FIG. 2 depicts another cross-sectional view of the liner assembly 106 in the wellbore 100, according to one or more embodiments. In at least one embodiment, the liner assembly 106 may not be cemented in place in the wellbore 100, as shown in FIG. 2. Rather, a packer 204 can be coupled to the liner 106 between the first and second frac valves 120, 130. The packer 204 can be a swellable mechanical or hydraulic packer adapted to expand radially-outward and provide zonal isolation between the first and second zones 128, 138. For example, the packer 204 can isolate a first, lower annulus 206 between the liner 106 and the wall 104 of the wellbore 200 from a second, upper annulus 208 between the liner 106 and the wall 104 of the wellbore 200. Although the liner 106 can be cemented in place (see FIG. 1) or not cemented in place (see FIG. 2), for purposes of simplicity, the following description will refer to the embodiment of FIG. 1 (cemented in place).

Figure 3:
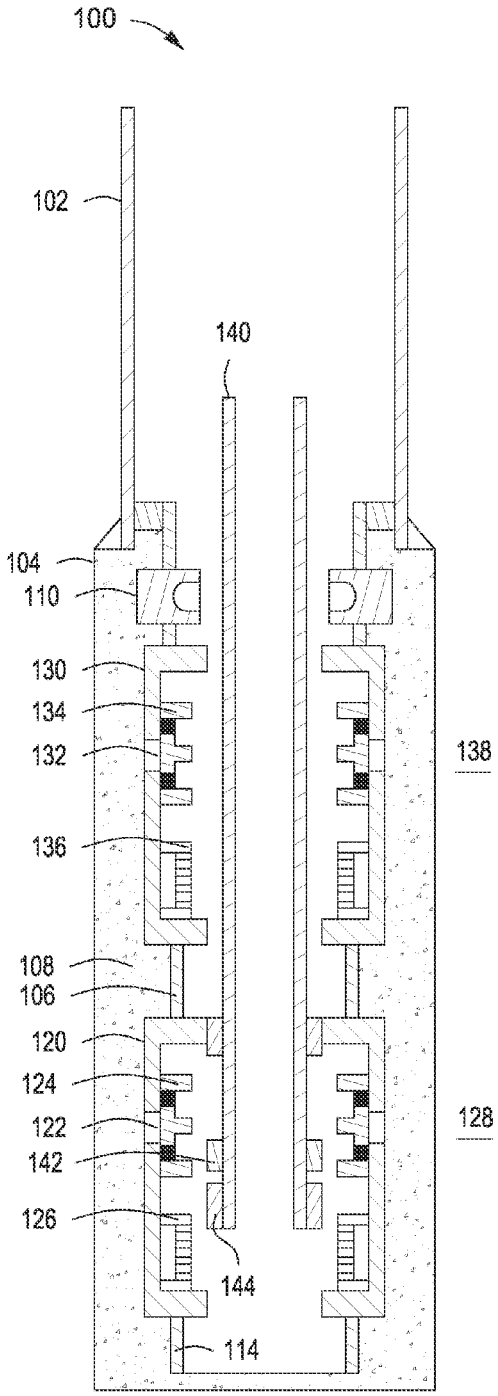
FIG. 3 depicts a cross-sectional view of the liner assembly having a service tool disposed therein, according to one or more embodiments described.

FIG. 3 depicts a cross-sectional view of the liner assembly 106 having a work string or service tool 140 disposed therein, according to one or more embodiments. Once the liner 106 has been cemented (or otherwise anchored) in place, the service tool 140 can be lowered into the wellbore 100. The service tool 140 can include one or more valve shifting tools (two are shown) 142, 144 coupled thereto. The first valve shifting tool 142 can be adapted to actuate the frac valves 120, 130 between the first, closed position and a second, open position. In the second position, the sleeves 124, 134 are positioned axially-offset from the ports 122, 132 such that the ports 122, 132 are unobstructed and fluid can flow therethrough. The second valve shifting tool 144 can be adapted to engage and open and/or close the formation isolation valve 110. The valve shifting tools 142, 144 can be collets, spring-loaded keys, drag blocks, snap ring constrained profiles, or the like.

Figure 4:
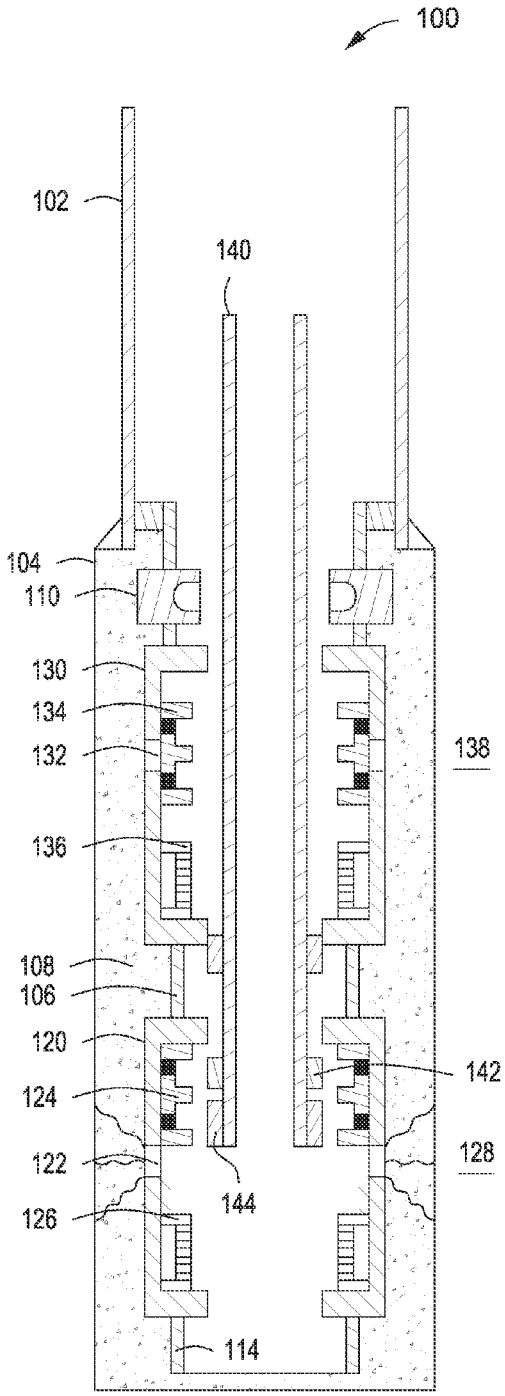
FIG. 4 depicts a cross-sectional view of the liner assembly having a first frac valve in an open position so that the first zone can be fractured, according to one or more embodiments described.

FIG. 4 depicts a cross-sectional view of the liner assembly 106 having the first frac valve 120 in the open position, according to one or more embodiments. The service tool 140 can move upward, and the first valve shifting tool 142 can engage and move the sleeve 124 of the first frac valve 120 into the second, open position. Once opened, proppant-laden fluid can flow through the service tool 140 and the port 122 of the first frac valve 120, thereby fracturing the first zone 128. As used herein, "upward" includes a direction toward the wellhead (not shown), and "downward" includes a direction away from the wellhead.

Figure 5:
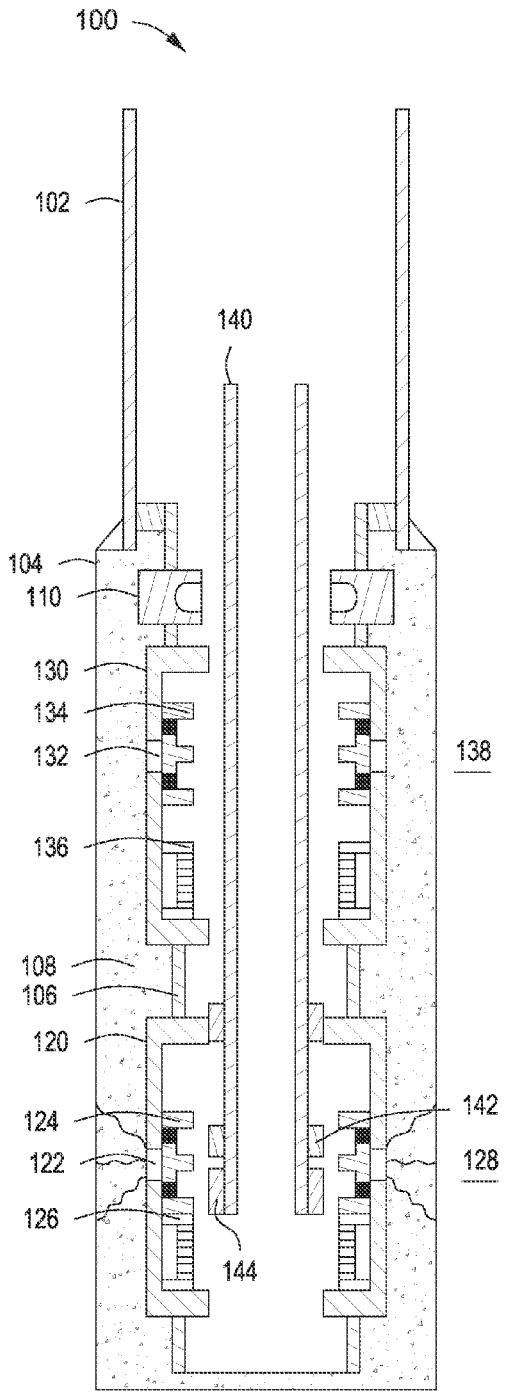
FIG. 5 depicts a cross-sectional view of the liner assembly having the first frac valve in a closed position after the first zone has been fractured, according to one or more embodiments described.

FIG. 5 depicts a cross-sectional view of the liner assembly 106 having the first frac valve 120 in the closed position after the first zone 128 has been fractured, according to one or more embodiments. Once the first zone 128 has been fractured, the service tool 140 can move downward, and the first valve shifting tool 142 can engage and move the sleeve 124 of the first frac valve 120 into the first, closed position.

Figure 6:
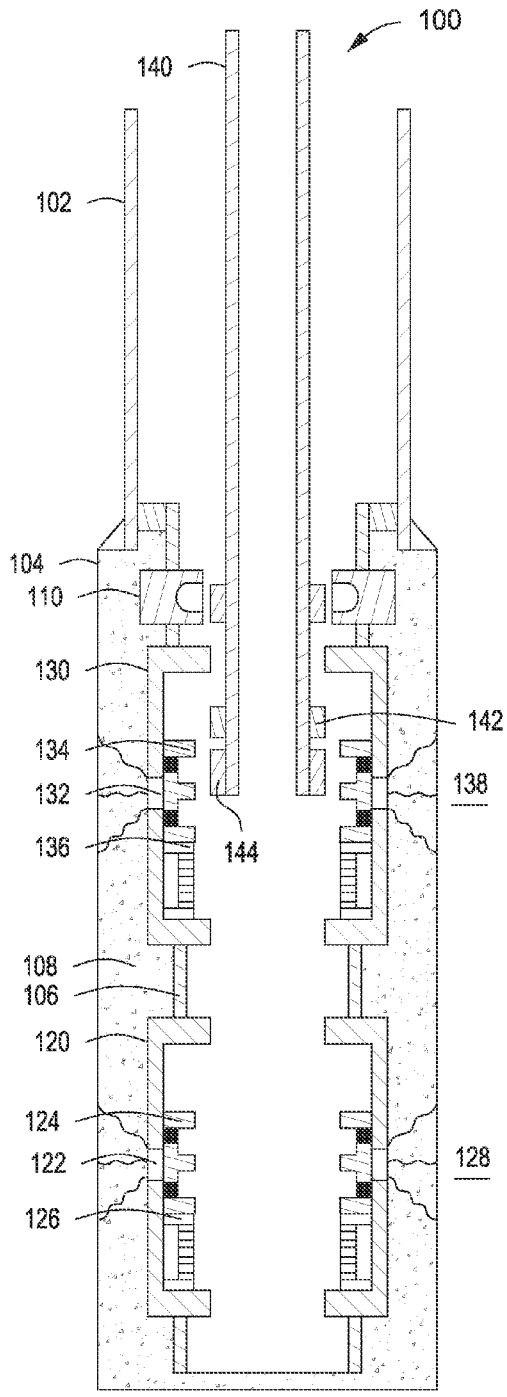
FIG. 6 depicts a cross-sectional view of the liner assembly having a second frac valve in a closed position after the second zone has been fractured, according to one or more embodiments described.

FIG. 6 depicts a cross-sectional view of the liner assembly 106 having the second frac valve 130 in the closed position after the second zone 138 has been fractured, according to one or more embodiments. Once the first zone 128 has been fractured, the service tool 140 can move upward, and the first valve shifting tool 142 can engage and move the sleeve 134 of the second frac valve 130 into the second, open position. In at least one embodiment, a different valve shifting tool (not shown) on the service tool 140 can be used to actuate the second sleeve 134. Once opened, proppant-laden fluid can flow through the service tool 140 and the port 132 of the second frac valve 130, thereby fracturing the second zone 138. Once the second zone 138 has been fractured, the service tool 140 can move downward, and the first valve shifting tool 142 can engage and move the sleeve 134 of the second frac valve 130 into the second, closed position. Although the figures depict two frac valves 120, 130 and two zones 128, 138, it may be appreciated that this process can be applied to any number of frac valves and zones.

Figure 7:
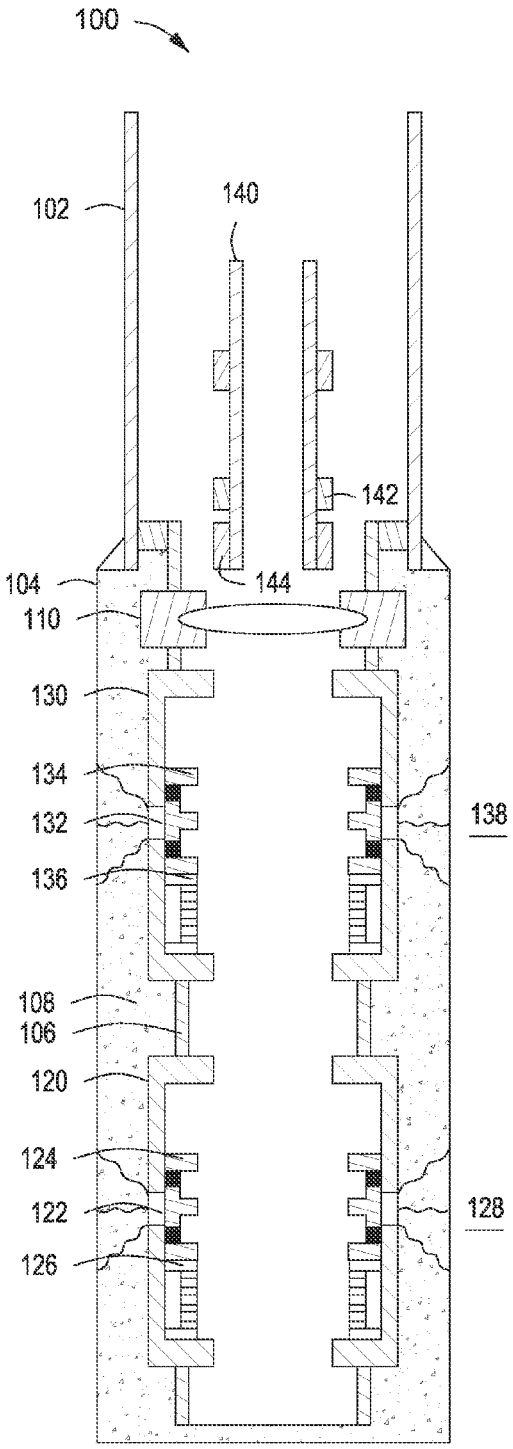
FIG. 7 depicts a cross-sectional view of the liner assembly with the formation isolation valve in a closed position, according to one or more embodiments described.

FIG. 7 depicts a cross-sectional view of the liner assembly 106 with the fluid loss 110 control valve in a closed position, according to one or more embodiments. Once the zones 128, 138 are fractured and the frac valves 120, 130 are in the closed position, the service tool 140 can be pulled out of the wellbore 100. As the service tool 140 moves past the formation isolation valve 110, the second valve shifting tool 144 can engage and actuate the formation isolation valve 110 into the closed position, thereby preventing the axial flow of fluid through the liner 106. As such, the formation isolation valve 110 can isolate the portion of the wellbore 100 above the formation isolation valve 110 from the portion of the wellbore 100 below the formation isolation valve 110.

Figure 8:
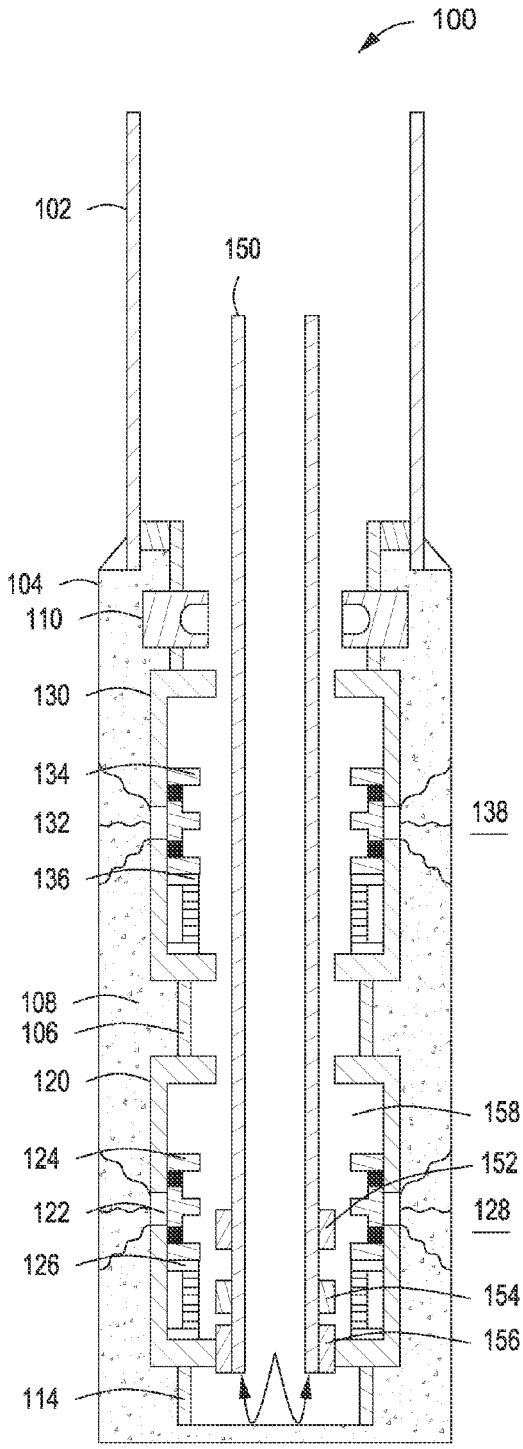
FIG. 8 depicts a cross-sectional view of the liner assembly having a work string or service tool disposed therein, according to one or more embodiments described.

FIG. 8 depicts a cross-sectional view of the liner assembly 106 having a work string or service tool 150 disposed therein, according to one or more embodiments. The service tool 150 can be the same as the service tool 140, or the service tool 150 can be different. The service tool 150 can include one or more valve shifting tools (three are shown) 152, 154, 156 coupled thereto. The valve shifting tools 152, 154, 156 can be similar to the valve shifting tools 142, 144 described above, or the valve shifting tools 152, 154, 156 can be different. The first valve shifting tool 152 can be adapted to actuate the frac valves 120, 130 between the first, closed position and the second, open position. The second valve shifting tool 154 can be adapted to actuate the frac valves 120, 130 into a third, filtering position, as discussed in more detail below. The third valve shifting tool 154 can be adapted to engage and open and/or close the formation isolation valve 110.

As the service tool 150 is lowered into the wellbore 100, the third valve shifting tool 154 can engage and actuate the formation isolation valve 110 into the open position. The service tool 150 can then move downward until an end of the service tool 150 is positioned proximate the lower end 114 of the liner 106. A circulating fluid can then flow down through the service tool 150 and back up an annulus 158 between the service tool 150 and the liner 106 and/or casing 102. The circulating fluid can wash out the interior of the wellbore 100 and return particulates and debris to the surface. The circulating fluid can be a viscous fluid, such as brine.

Figure 9:
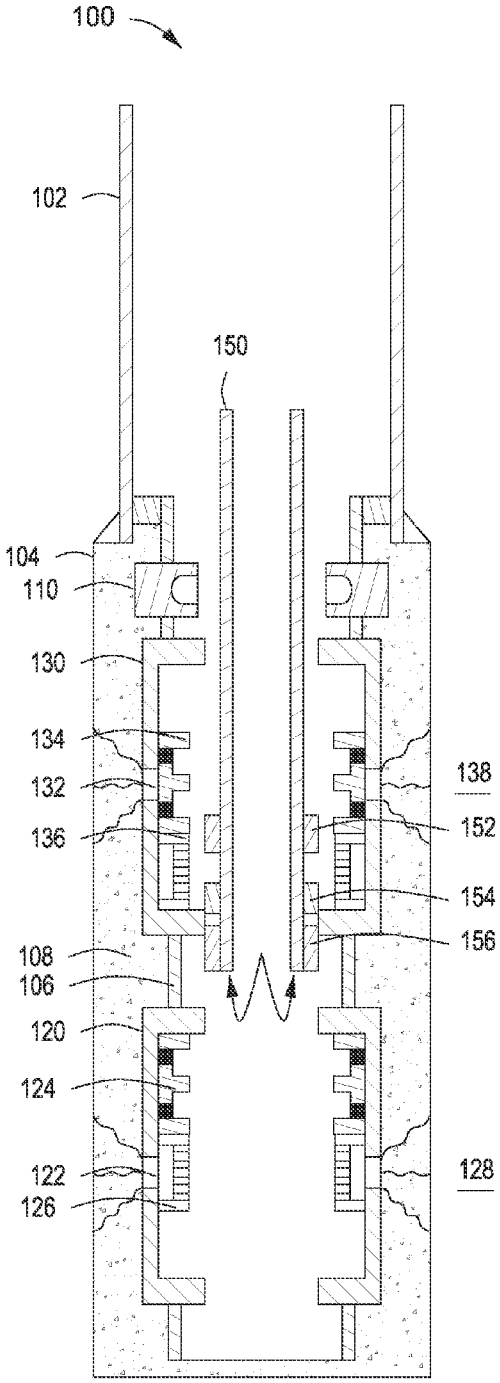
FIG. 9 depicts a cross-sectional view of the liner assembly having the first frac valve in a filtering position, according to one or more embodiments described.

FIG. 9 depicts a cross-sectional view of the liner assembly 106 having the first frac valve 120 in a third, filtering position, according to one or more embodiments. The service tool 150 can continue to inject the circulating fluid into the wellbore 100 as the service tool 150 is pulled out of the wellbore 100. As the service tool 150 moves upward, the first valve shifting tool 152 can engage the sleeve 124 and actuate the first frac valve 120 from the first, closed position to the second, open position. The second valve shifting tool 154 can then engage the screen 128 and actuate the first frac valve 120 into the third, filtering position. Alternatively, the second valve shifting tool 154 can engage the screen 128 and simultaneously move both the sleeve 124 and the screen 126, thereby moving the first frac valve 120 from the first, closed position to the third, filtering position.

When the first frac valve 120 is in the filtering position, the screen 126 can be axially-adjacent to the port 122 and adapted to filter a fluid, e.g., a hydrocarbon stream, flowing from the first zone 128 into the interior of the liner 106. As such, the screen 126 can reduce the amount of solid particulates, such as sand, flowing into the interior of the liner 106 and up to the surface.

Figure 10:
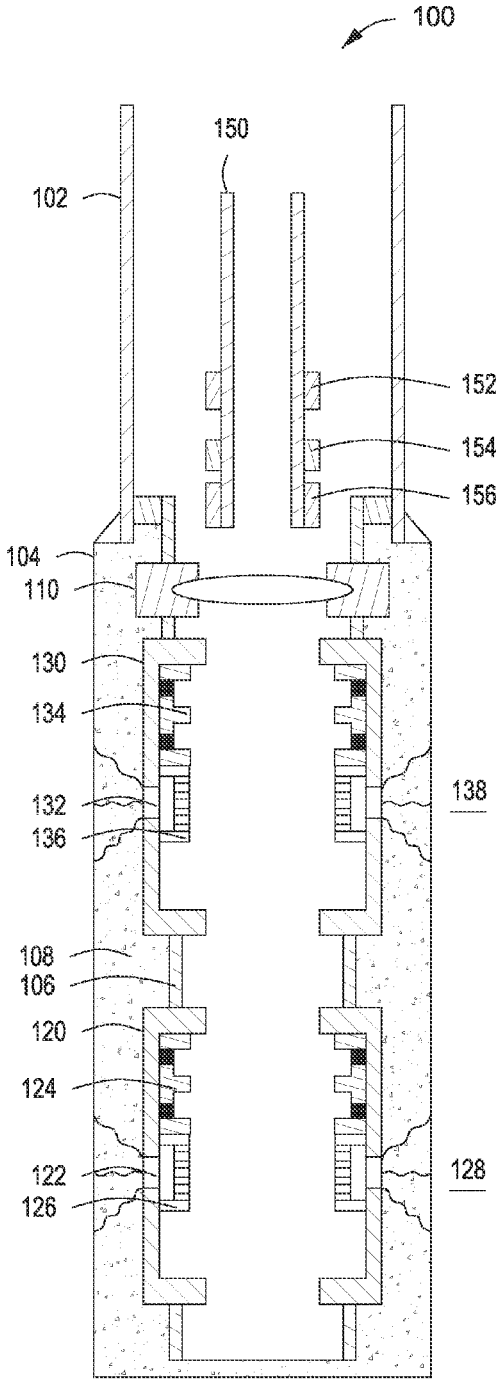
FIG. 10 depicts a cross-sectional view of the liner assembly having the second frac valve in a filtering position, according to one or more embodiments described.

FIG. 10 depicts a cross-sectional view of the liner assembly 106 having the second frac valve 130 in the filtering position, according to one or more embodiments. As the service tool 140 continues moving upward and out of the wellbore 100, the second frac valve 130 can be actuated into the filtering position in the same manner as the first frac valve 120. The service tool 140 can then move above the liner 106, and the third valve shifting tool 156 can engage and actuate the formation isolation valve 110 into the closed position.

Figure 11:
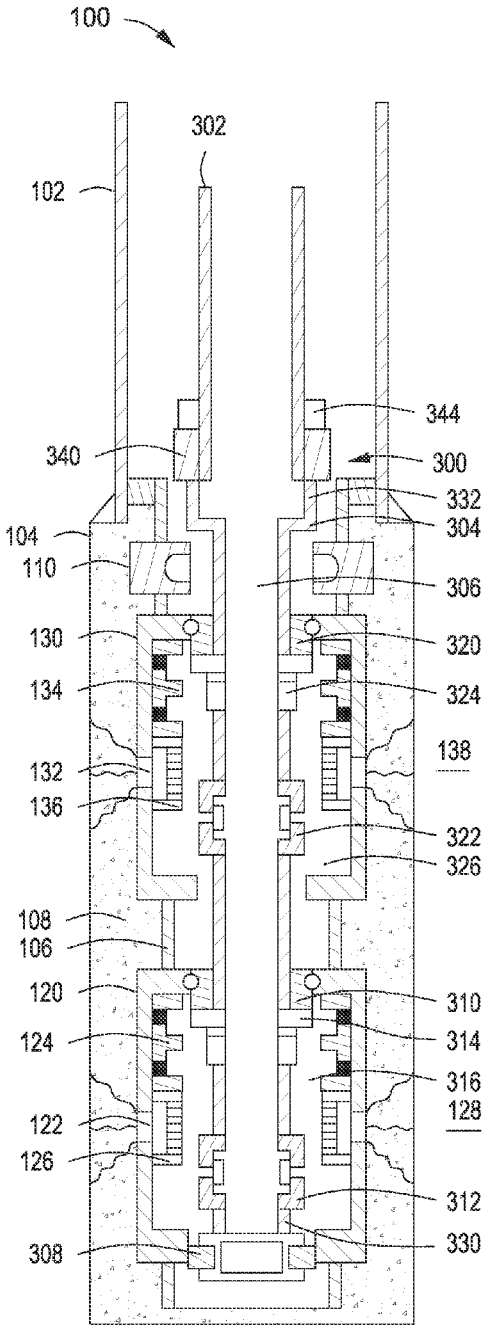
FIG. 11 depicts a cross-sectional view of the liner assembly having a lower completion assembly disposed therein, according to one or more embodiments described.

FIG. 11 depicts a cross-sectional view of the liner assembly 106 having a lower completion assembly 300 disposed therein, according to one or more embodiments. Once the frac valves 120, 130 are in the filtering position, the lower completion assembly 300 can be run into the wellbore 100. For example, the lower completion assembly 300 can be lowered into the wellbore 100 with a pipe 302 and disposed at least partially within the liner 106, as shown. The lower completion assembly 300 can include a tubing or body 304 having a bore 306 formed partially or completely therethrough, one or more valve shifting tools (one is shown) 308, one or more packers (two are shown) 310, 320, one or more sliding sleeve valves (two are shown) 312, 322, and one or more flow control valves (two are shown) 314, 324.

The valve shifting tool 308 can be coupled to a first end 330 of the body 304. The valve shifting tool 308 can engage and actuate the fluid loss control device 110 between the open and closed positions. For example, the fluid loss control device 110 can be actuated into the open position as the lower completion assembly 300 is run downhole. The valve shifting tool 308 can be similar to the valve shifting tools 144, 156 described above, or the valve shifting tool 308 can be different.

The packers 310, 320 can also be coupled to the body 304. The packers 310, 320 can be set mechanically or hydraulically. The first packer 310 can be positioned proximate the first frac valve 120. When set, the first packer 310 can expand radially-outward and isolate the first frac valve 120 and first zone 128 from the second frac valve 130 and second zone 138. As such, a first annulus 316 can be formed between the liner 106 and the lower completion assembly 300. The second packer 320 can be positioned proximate the second frac valve 130. When set, the second packer 320 can expand radially-outward and isolate the second frac valve 130 and second zone 138 from any frac valves and/or zones positioned thereabove. A second annulus 326 can be formed between the liner 106 and the lower completion assembly 300. The first and second annuli 316, 326 can be isolated from one another by the first packer 310.

The first sliding sleeve valve 312 can be positioned proximate the first zone 128 and be actuated between an open and a closed position. When in the open position, the first sliding sleeve valve 312 can provide a path of communication between the first annulus 316 and the bore 306 of the lower completion assembly 300. When in the closed position, the first sliding sleeve valve 312 can prevent fluid from flowing between the first annulus 316 and the bore 306. The second sliding sleeve valve 322 can be positioned proximate the second zone 138 and be actuated between an open and a closed position. When in the open position, the second sliding sleeve valve 322 can provide a path of communication between the second annulus 326 and the bore 306 of the lower completion assembly 300. When in the closed position, the second sliding sleeve valve 322 can prevent fluid from flowing between the second annulus 326 and the bore 306. As the lower completion assembly 300 is lowered into position, the sliding sleeve valves 312, 322 can be in the closed position. In at least one embodiment, the sliding sleeve valves 312, 322 can act as back-up or contingency valves to the flow control valves 314, 324.

The first flow control valve 314 can be positioned proximate the first zone 128 and be actuated between an open position and a closed position. When in the open position, the first flow control valve 314 can provide a path of communication between the first annulus 316 and the bore 306 of the lower completion assembly 300. When in the closed position, the first flow control valve 314 can prevent fluid from flowing between the first annulus 316 and the bore 306. The second flow control valve 324 can be positioned proximate the second zone 138 and be actuated between an open and a closed position. When in the open position, the second flow control valve 324 can provide a path of communication between the second annulus 326 and the bore 306 of the lower completion assembly 300. When in the closed position, the second flow control valve 324 can prevent fluid from flowing between the second annulus 326 and the bore 306. As the lower completion assembly 300 is lowered into position, the flow control valves 314, 324 can be in the closed position. In at least one embodiment, the flow control valves 314, 324 can be actuated hydraulically, electrically, mechanically, or by any other technique known in the art.

In at least one embodiment, a hydraulic wet connection 340 can be coupled to a second end 332 of the lower completion assembly 300. The hydraulic connection 340 can be adapted to provide hydraulic power to the flow control valves 314, 324 to enable them to actuate between the open and closed positions. For example, the hydraulic connection 340 can provide hydraulic power to the flow control valves 314, 324 via one or more hydraulic lines. The hydraulic connection 340 can include a male or female coupler.

In at least one embodiment, an inductive wet connection 344 can be coupled to the second end 332 of the lower completion assembly 300. The inductive connection 344 can be adapted to provide electric power to at least one sensor, e.g., pressure, temperature, flow, vibration, seismic and/or the flow control valves 314, 324 to enable them to actuate between the open and closed positions. For example, the inductive connection 344 can provide electric power to the flow control valves 314, 324 via one or more electric lines. The inductive connection 344 can include a male or female coupler. Either or both of the hydraulic connection 340 and the inductive connection 344 can be used to actuate the flow control valves 314, 324.

In at least one embodiment a fiber optic cable wet connection (not shown) can be coupled between lower completion assembly 300 and the upper completion assembly 400. A fiber optic cable can be run along with lower completion assembly 300 for sensing distributed temperature, pressure, vibration, and the like.

Figure 12:
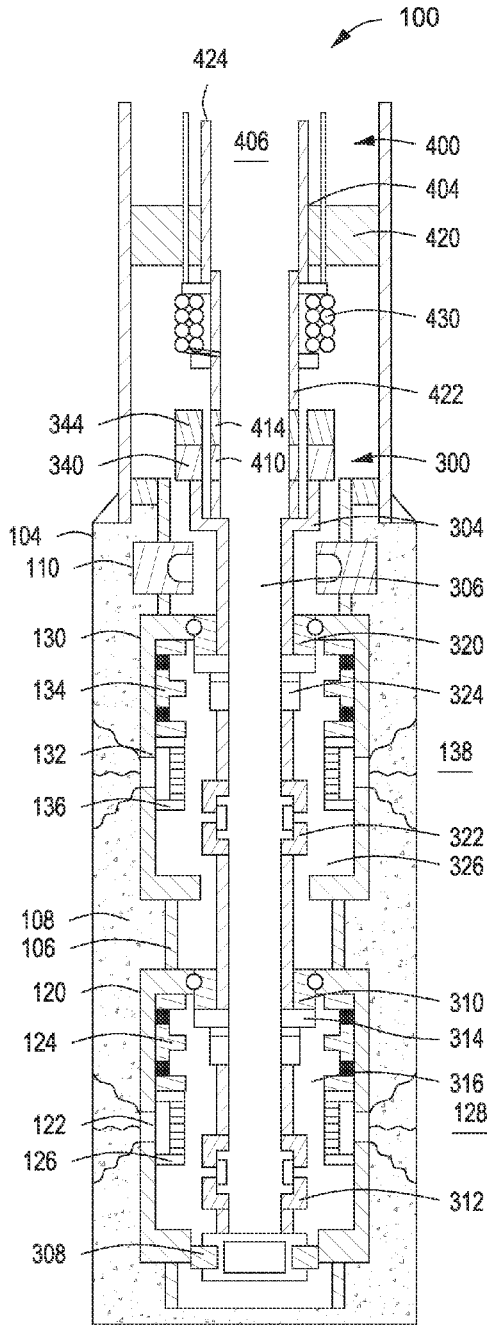
FIG. 12 depicts a cross-sectional view of an upper completion assembly coupled to the lower completion assembly, according to one or more embodiments described.

FIG. 12 depicts a cross-sectional view of an upper completion assembly 400 coupled to the lower completion assembly 300, according to one or more embodiments. In at least one embodiment, once the lower completion assembly 300 is in place and the packers 310, 320 are set, the pipe 302 can be pulled out of the wellbore 100, and the upper completion assembly 400 can be run into the wellbore 100. In another embodiment, the lower completion assembly 300 and the upper completion assembly 400 can be run into the wellbore 100 in a single trip. The upper completion assembly 400 can include a tubing or body 404 having a bore 406 formed partially or completely therethrough, a hydraulic wet connection 410, an inductive wet connection 414, a packer 420, and a telescoping joint 430.

The hydraulic connection 410 and the inductive connection 414 can be coupled to a first end 422 of the body 404. The hydraulic connection 410 of the upper completion assembly 400 can be aligned with and connected to the hydraulic connection 340 of the lower completion assembly 300. In at least one embodiment, the hydraulic connection 410 of the upper completion assembly 400 can include a male coupler, and the hydraulic connection 340 of the lower completion assembly 300 can include a female coupler. Once connected, hydraulic power can be provided to the flow control valves 314, 324 via the hydraulic connections 340, 410.

The inductive connection 414 of the upper completion assembly 400 can also be aligned with and connected to the inductive connection 344 of the lower completion assembly 400. In at least one embodiment, the induction connection 414 of the upper completion assembly 400 can include a male coupler, and the inductive connection 344 of the lower completion assembly 300 can include a female coupler. Once connected, electric power can be provided to the flow control valves 314, 324 via the inductive connections 344, 414.

The second end 424 of the body 404 can be coupled to a tubing hangar (not shown). The telescoping joint 430 can allow the upper completion assembly 400 to expand and/or contract in length to enable the connections at either end 422, 424. Once coupled to the hydraulic connection 410, the inductive connection 414, and/or the tubing hangar, the packer 420 can be set. When set, the packer 420 can expand radially-outward and anchor the upper completion assembly 400 in place within the wellbore 100.

Once the upper completion assembly 400 is coupled to the lower completion assembly 300 and anchored in place, one or more of the flow control valves 314, 324 can be actuated to the open position. For example, the flow control valves 314, 324 can be actuated to the open position by the hydraulic connection 340, 410 and/or the inductive connection 344, 414. Once open, the wellbore 100 can begin producing. A first fluid, e.g., a hydrocarbon stream, can flow from the first zone 128, through the first port 122, the first screen 126, the first annulus 316, and the first flow control valve 314 and into the bore 306 of the lower completion assembly 300. Likewise, a second fluid can flow from the second zone 138, through the second port 132, the second screen 136, the second annulus 326, and the second flow control valve 324 and into the bore 306 of the lower completion assembly 300. The fluid can flow up the lower completion assembly 300, the upper completion assembly 400, and to the surface.

Figure 13:
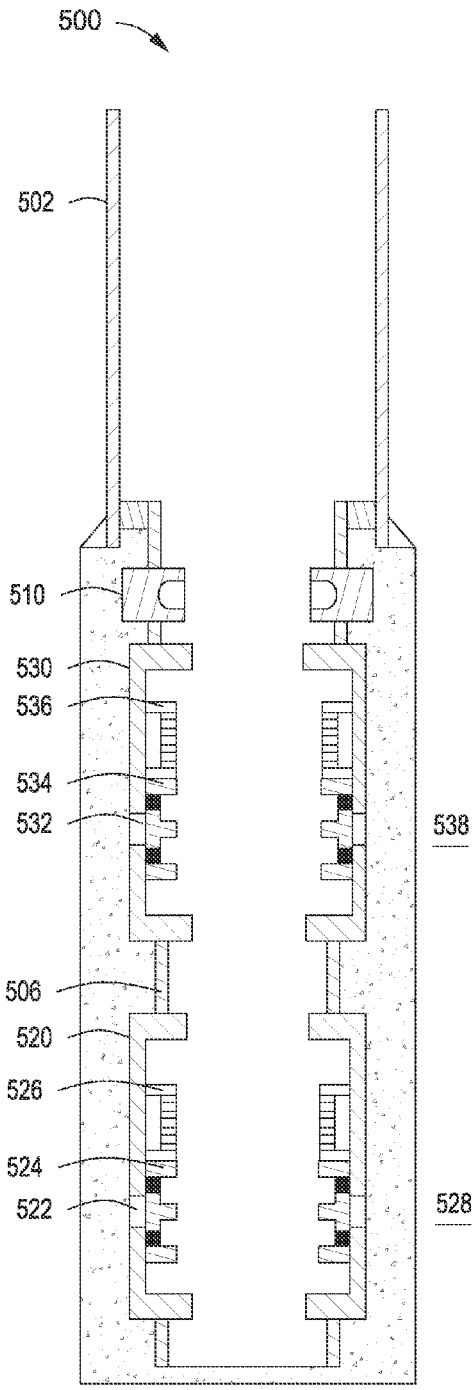
FIG. 13 depicts a cross-sectional view of another liner assembly in a wellbore, according to one or more embodiments described.

FIG. 13 depicts a cross-sectional view of another liner assembly 506 in a cased wellbore 500, according to one or more embodiments described. The wellbore 500 and the liner assembly 506 can be similar to the wellbore 100 and liner assembly 106 shown and described in FIG. 1, and like components will not be described again in detail. The liner assembly 506 in FIG. 5, however, can include a different orientation of the sliding sleeves 524, 534 and the screens 526, 536. More particularly, the sliding sleeves 524, 534 can be positioned below the screens 526, 536 in their respective frac valves 520, 530. This can allow for fewer trips in and out of the wellbore 500 with a work string or service tool 540, as described in more detail below.

Figure 14:
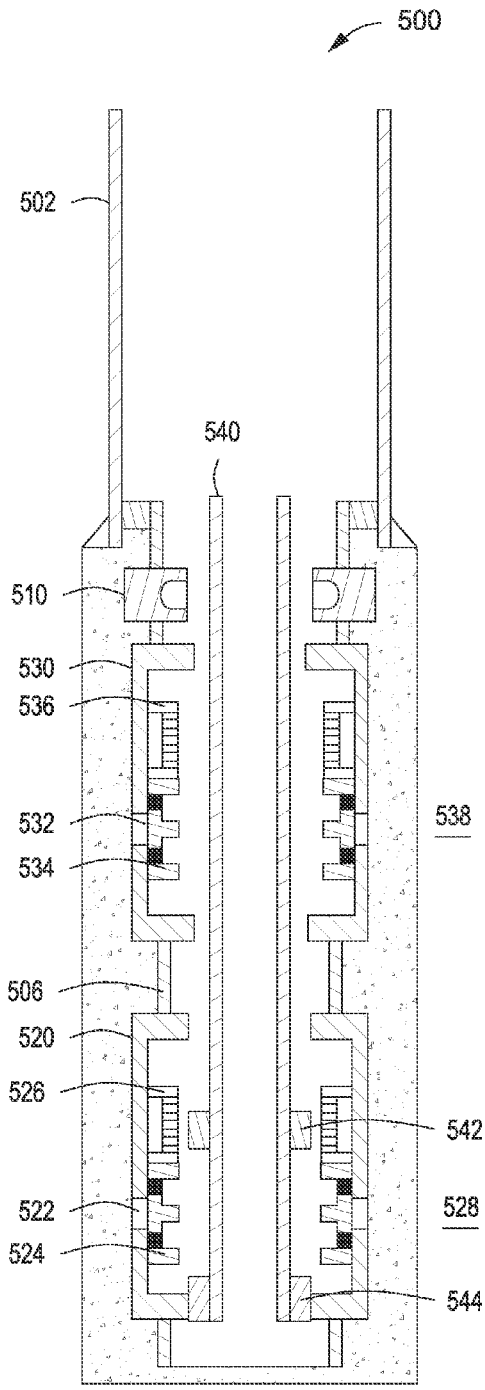
FIG. 14 depicts a cross-sectional view of the liner assembly having a work string or service tool disposed therein, according to one or more embodiments described.

FIG. 14 depicts a cross-sectional view of the liner assembly 506 having a work string or service tool 540 disposed therein, according to one or more embodiments described. Once the liner 506 has been cemented into place, the service tool 540 can be lowered into the wellbore 500. The service tool 540 can include one or more valve shifting tools (two are shown) 542, 544 coupled thereto. The first valve shifting tool 542 can be adapted to actuate the frac valves 520, 530 between the first, closed position and a second, open position. The second valve shifting tool 544 can be adapted to engage and open and/or close the formation isolation valve 510.

Figure 15:
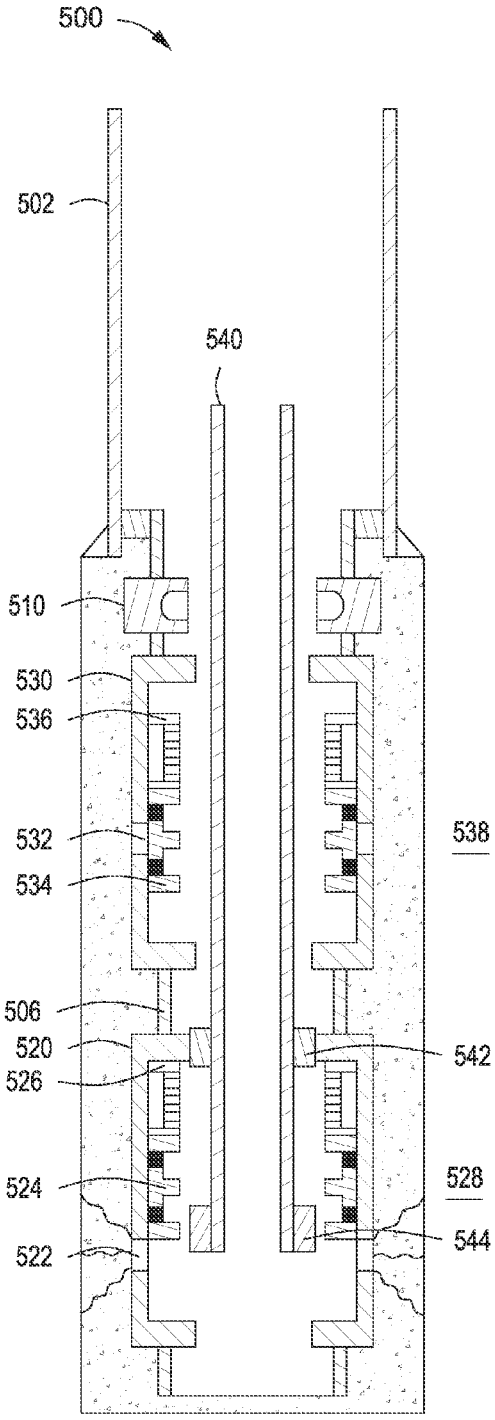
FIG. 15 depicts a cross-sectional view of the liner assembly having a first frac valve in an open position so that the first zone can be fractured, according to one or more embodiments described.

FIG. 15 depicts a cross-sectional view of the liner assembly 506 having the first frac valve 520 in an open position so that the first zone 528 can be fractured, according to one or more embodiments described. The service tool 540 can move upward, and the first valve shifting tool 542 can engage and move the sleeve 524 of the first frac valve 520 into the second, open position. Once opened, proppant-laden fluid can flow through the service tool 540 and the port 522 of the first frac valve 520, thereby fracturing the first zone 528. The service tool 540 can then move downward, and the first valve shifting tool 542 can engage and move the sleeve 524 of the first frac valve 520 back into the first, closed position.

Figure 16:
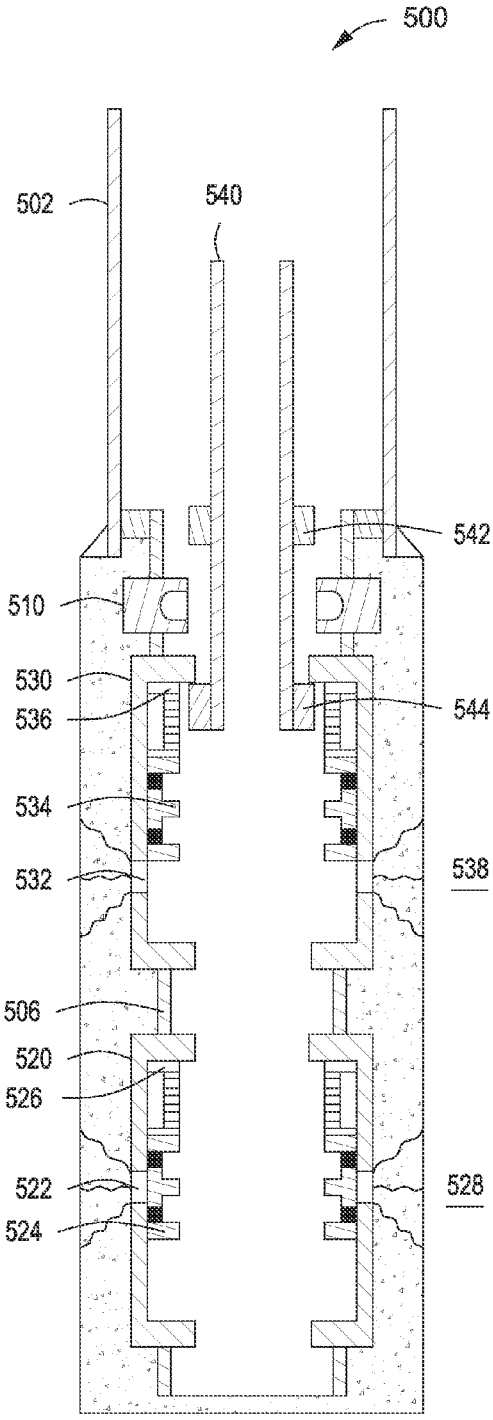
FIG. 16 depicts a cross-sectional view of the liner assembly having second frac valve in an open position so that the second zone can be fractured, according to one or more embodiments described.

FIG. 16 depicts a cross-sectional view of the liner assembly 506 having second frac valve 530 in an open position so that the second zone 538 can be fractured, according to one or more embodiments described. After the first zone 528 has been fractured, the service tool 540 can move upward, and the first valve shifting tool 542 can engage and move the sleeve 534 of the second frac valve 530 into the second, open position. Once opened, the proppant-laden fluid can flow through the service tool 540 and the port 532 of the second frac valve 530, thereby fracturing the first zone 538. The service tool 540 can then move downward, and the first valve shifting tool 542 can engage and move the sleeve 534 of the first frac valve 530 back into the first, closed position (not shown). This process can be repeated for any number of frac valves and zones.

Figure 17:
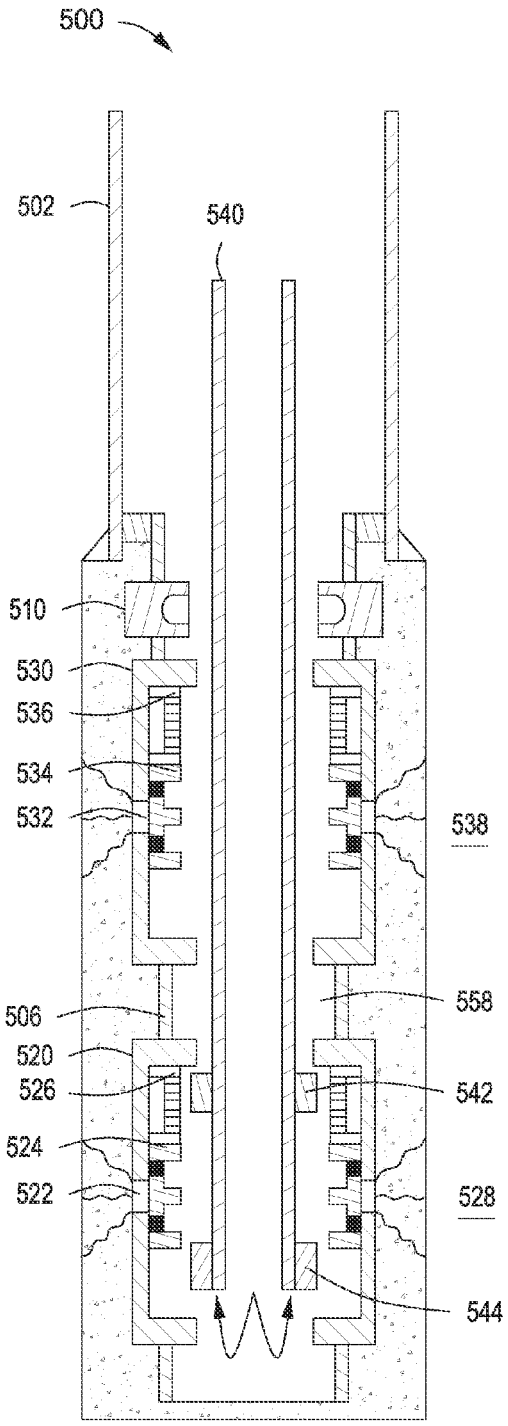
FIG. 17 depicts a cross-sectional view of the service tool performing a wash-out of the liner assembly, according to one or more embodiments described.

FIG. 17 depicts a cross-sectional view of the service tool 540 performing a wash-out of the liner assembly 506, according to one or more embodiments described. Once the zones 528, 538 have been fractured, the service tool 540 can move downward toward the lower end 514 of the liner 506. The service tool 540 can actuate the sleeves 524, 534 into the third, filtering position. A circulating fluid can then flow through the service tool 540 and return through an annulus 558 between the service tool 540 and the liner 506 and/or casing 502. The circulating fluid helps wash out the interior of the wellbore 500 and return particulates and debris to the surface.

Figure 18:
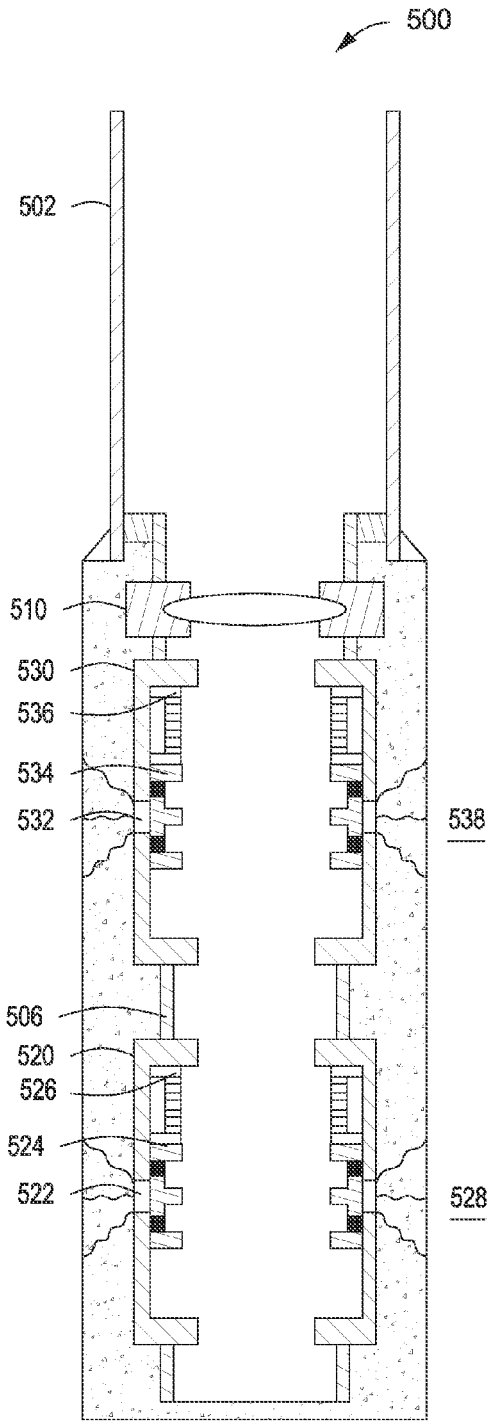
FIG. 18 depicts a cross-sectional view of the liner assembly with the formation isolation valve in a closed position, according to one or more embodiments described.

FIG. 18 depicts a cross-sectional view of the liner assembly 506 with the formation isolation valve 510 in a closed position, according to one or more embodiments described. Once the zones 528, 538 are fractured, the service tool 540 can be pulled out of the wellbore 500. In at least one embodiment, the frac valves 520, 530 can be in the open position when the service tool 540 is pulled out of the wellbore 500; however, in another embodiment, the frac valves 520, 530 can be in the closed position or the filtering position. For example, the service tool 540 can shift the first and second frac valves 520, 530 into the filtering position as the service tool 540 is pulled out of the wellbore 500. As the service tool 540 moves past the formation isolation valve 510, the second valve shifting tool 544 can engage and actuate the formation isolation valve 510 into the closed position, thereby preventing the axial flow of fluid through the liner 506. As such, the formation isolation valve 510 can isolate the portion of the wellbore 500 above the formation isolation valve 510 from the portion of the wellbore 500 below the formation isolation valve 510.

Figure 19:
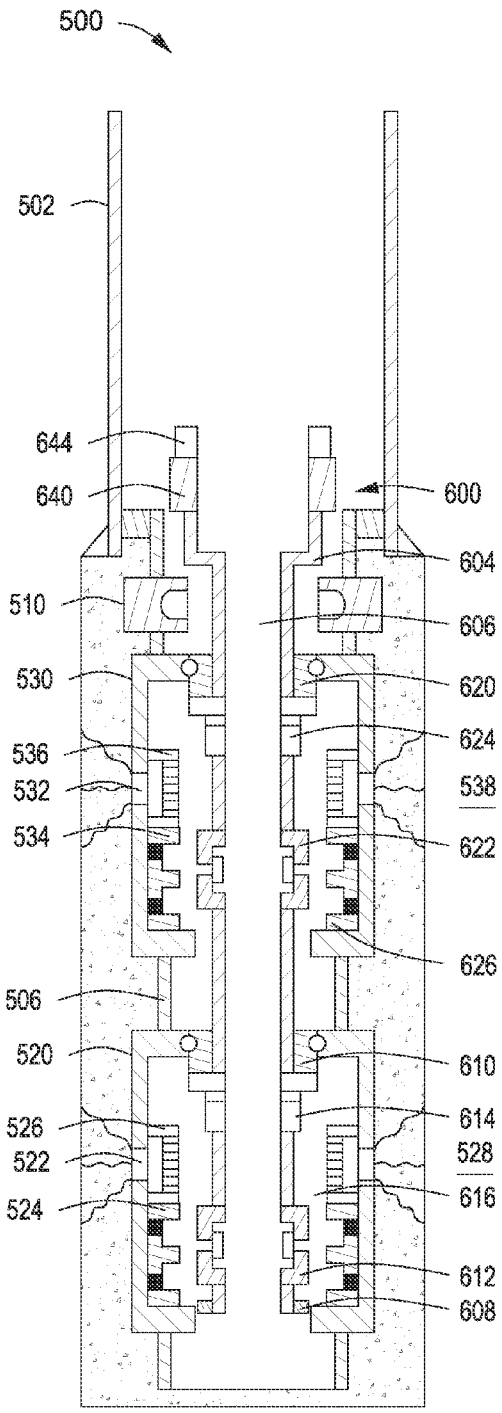
FIG. 19 depicts a cross-sectional view of the liner assembly having a lower completion assembly disposed therein, according to one or more embodiments described.

FIG. 19 depicts a cross-sectional view of the liner assembly 506 having a lower completion assembly 600 disposed therein, according to one or more embodiments described. The lower completion assembly 600 can include a tubing or body 604 having a bore 606 formed partially or completely therethrough, a valve shifting tool 608, one or more packers (two are shown) 610, 620, one or more sliding sleeve valves (two are shown) 612, 622, and one or more flow control valves (two are shown) 614, 624. The lower completion assembly 600 can be similar to the lower completion assembly 300 shown and described in FIG. 11, and like components will not be described again in detail.

The lower completion assembly 600 can be lowered into the wellbore 100 and disposed at least partially within the liner 506, as shown. As the lower completion assembly 600 is lowered, the valve shifting tool 608 coupled to an end thereof, can engage and actuate the fluid loss control device 510 between the open and closed positions. For example, the fluid loss control device 510 can be actuated into the open position when the lower completion assembly 600 is run downhole. The lower completion assembly 600 can also be adapted to shift the frac valves 520, 530 into the filtering position, as shown. In another embodiment, however, the service tool 540 can be adapted to shift the frac valves 520, 530 into the filtering position.

The first packer 610 can be positioned proximate the first frac valve 520. When set, the first packer 610 can expand radially-outward and isolate the first frac valve 520 and first zone 528 from the second frac valve 530 and second zone 538. As such, a first annulus 616 can be formed between the liner 506 and the lower completion assembly 600. The second packer 620 can be positioned proximate the second frac valve 530. When set, the second packer 620 can expand radially-outward and isolate the second frac valve 530 and second zone 538 from any frac valves and/or zones positioned thereabove. A second annulus 626 can be formed between the liner 506 and the lower completion assembly 600. The first and second annuli 616, 626 can be isolated from one another by the first packer 610.

The first sliding sleeve valve 612 can be positioned proximate the first zone 528 and be actuated between an open and a closed position. The second sliding sleeve valve 622 can be positioned proximate the second zone 538 and be actuated between an open and a closed position. As the lower completion assembly 300 is lowered into position, the sliding sleeve valves 612, 622 can be in the closed position.

The first flow control valve 614 can be positioned proximate the first zone 528 and be actuated between an open position and a closed position. The second flow control valve 624 can be positioned proximate the second zone 538 and be actuated between an open and a closed position. As the lower completion assembly 600 is lowered into position, the flow control valves 614, 624 can be in the closed position. In at least one embodiment, the flow control valves 614, 624 can be actuated hydraulically, electrically, mechanically, or by any other technique known in the art.

In at least one embodiment, a hydraulic wet connection 640 can be coupled to a second end 632 of the lower completion assembly 600. The hydraulic connection 640 can be adapted to provide hydraulic power to the flow control valves 614, 624 to enable them to actuate between the open and closed positions. In at least one embodiment, an inductive wet connection 644 can also be coupled to the second end 632 of the lower completion assembly 600. The inductive connection 344 can be adapted to provide electric power to the flow control valves 314, 324 to enable them to actuate between the open and closed positions. Either or both of the hydraulic connection 640 and the inductive connection 644 can be used to actuate the flow control valves 614, 624.

Figure 20:
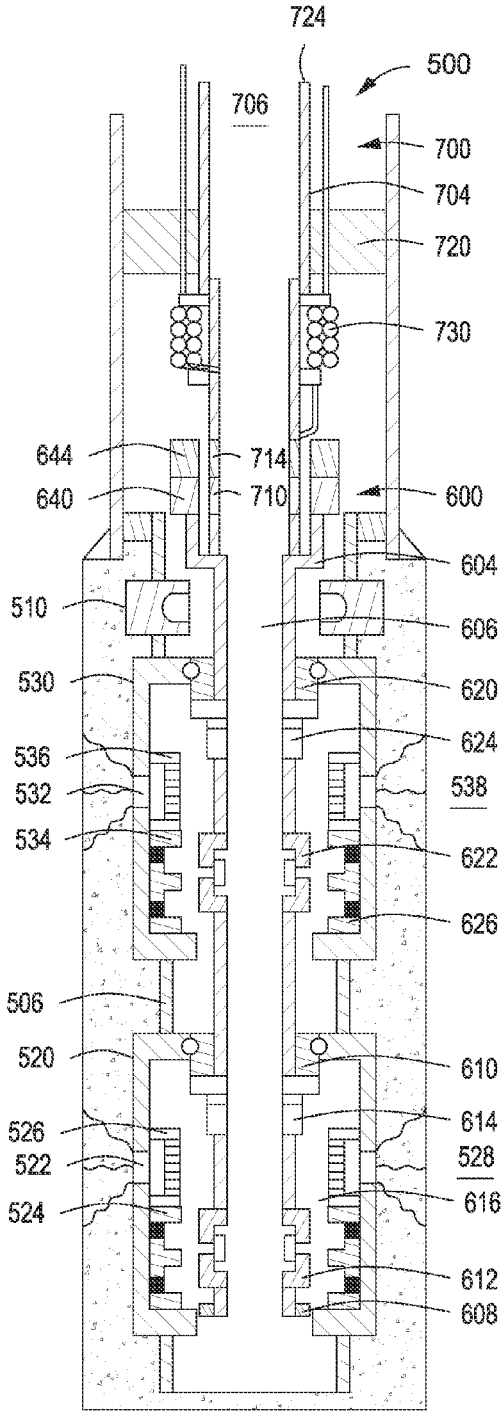
FIG. 20 depicts a cross-sectional view of an upper completion assembly coupled to the lower completion assembly, according to one or more embodiments described.

FIG. 20 depicts a cross-sectional view of an upper completion assembly 700 coupled to the lower completion assembly 600, according to one or more embodiments. Once the lower completion assembly 600 is in place and the packers 610, 620 are set, the upper completion assembly 700 can be run into the wellbore 500. In another embodiment, the lower completion assembly 600 and the upper completion assembly 700 can be run into the wellbore 500 together. The upper completion assembly 700 can include a body 704 having a bore 706 formed partially or completely therethrough, a hydraulic wet connection 710, an inductive wet connection 714, a packer 720, and a telescoping joint 730. The upper completion assembly 700 can be similar to the upper completion assembly 400 shown and described in FIG. 12, and like components will not be described again in detail.

The hydraulic connection 710 of the upper completion assembly 700 can be aligned with and connected to the hydraulic connection 640 of the lower completion assembly 600. Once connected, hydraulic power can be provided to the flow control valves 614, 624 via the hydraulic connections 640, 710. The inductive connection 714 of the upper completion assembly 700 can also be aligned with and connected to the inductive connection 644 of the lower completion assembly 600. Once connected, electric power can be provided to the flow control valves 614, 624 via the inductive connections 644, 714.

Once the upper completion assembly 700 is coupled to the lower completion assembly 600 and anchored in place, one or more of the flow control valves 614, 624 can be actuated to the open position. For example, the flow control valves 614, 624 can be actuated to the open position by the hydraulic connection 640, 710 and/or the inductive connection 644, 714. Once open, the wellbore 500 can begin producing. Fluid, e.g., a hydrocarbon stream, can flow from the first zone 528, through the first port 522, the first screen 526, the first annulus 616, and the first flow control valve 614 and into the bore 606 of the lower completion assembly 600. Likewise, fluid can flow from the second zone 538, through the second port 532, the second screen 536, the second annulus 626, and the second flow control valve 624 and into the bore 606 of the lower completion assembly 600. The fluid can flow up the lower completion assembly 600, the upper completion assembly 700, and to the surface.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention can be devised without departing from the basic scope thereof, and the scope thereof is determined by the claims that follow.

What is claimed is:

1. A system for producing from multiple zones in a subterranean formation, comprising:

a liner, comprising:

a first frac valve;

a second frac valve positioned above the first frac valve; and a formation isolation valve positioned above the second frac valve; and a completion assembly disposed at least partially within the liner, comprising:

a valve shifting tool adapted to actuate the formation isolation valve between an open position and a closed position;

a first flow control valve in fluid communication with the first frac valve; and a second flow control valve in fluid communication with the second frac valve, wherein the first frac valve comprises:

a port formed radially therethrough;

a sliding sleeve adapted to prevent a fluid from flowing through the port when the first frac valve is in a closed position; and a screen adapted to filter the fluid flowing through the port when the first frac valve is in a filtering position.

2. The system of claim 1, wherein the completion assembly comprises:

a lower completion assembly comprising the valve shifting tool, the first flow control valve, and the second flow control valve; and an upper completion assembly disposed above and coupled to the lower completion assembly, wherein the upper completion assembly comprises:

a packer adapted to anchor the upper completion assembly in place; and a telescoping joint adapted to adjust an axial length of the upper completion assembly.

3. The system of claim 1, wherein at least one of the first frac valve and the second frac valve comprises a plurality of frac valves.

4. The system of claim 1, wherein the sliding sleeve is positioned above the screen.

5. The system of claim 1, wherein the sliding sleeve is positioned below the screen.

6. The system of claim 1, wherein the formation isolation valve is adapted to allow fluid to flow axially through the liner when in the open position and prevent fluid from flowing axially through the liner when in the closed position.

7. The system of claim 1, wherein the lower completion assembly further comprises:

at least one sensor coupled thereto; and at least one of a fiber optic connection, an electrical connection, and an inductive connection adapted to provide communication to the at least one sensor.

8. The system of claim 1, wherein the liner is cemented in place within a wellbore.

9. The system of claim 1, wherein the liner further comprises a packer coupled thereto and disposed between the first and second frac valves.

10. A method for producing from multiple zones in a subterranean formation, comprising:

running a liner into a wellbore, wherein the liner comprises a formation isolation valve, a first frac valve, and a second frac valve, and wherein the first frac valve is disposed adjacent a first zone, the second frac valve is disposed adjacent a second zone, and the formation isolation valve is disposed above the first and second frac valves;

fracturing the first and second zones;

positioning a lower completion assembly comprising a first flow control valve and a second flow control valve at least partially within the liner such that the first flow control valve is in fluid communication with the first frac valve, and the second flow control valve is in fluid communication with the second frac valve;

positioning an upper completion assembly in the wellbore above the lower completion assembly;

opening the first and second flow control valves;

flowing a first fluid from the first zone through the first frac valve and first flow control valve and into an inner bore of the lower completion assembly; and flowing a second fluid from the second zone through the second frac valve and second flow control valve and into the inner bore of the lower completion assembly.

11. The method of claim 10, wherein fracturing the first zone comprises:

opening the first frac valve with a service tool;

flowing a proppant-laden fluid through the service tool and the first frac valve; and closing the first valve with the service tool.

12. The method of claim 10, wherein opening the first and second flow control valves comprises providing at least one of power and communication to the first and second flow control valves via a connection coupled to the lower completion assembly.

13. The method of claim 10, further comprising cementing the liner in place within the wellbore.

14. The method of claim 10, further comprising expanding a packer coupled to the liner to isolate the first zone from the second zone.

15. A method for producing from multiple zones in a subterranean formation, comprising:

cementing a liner in a wellbore, wherein the wellbore is disposed in a formation including first and second zones, wherein the liner comprises a formation isolation valve, a first frac valve, and a second frac valve, and wherein the first frac valve is disposed adjacent the first zone, and the second frac valve is disposed adjacent the second zone;

opening the first frac valve with a first valve shifting tool coupled to a service tool and fracturing the first zone;

closing the first frac valve with the first valve shifting tool;

opening the second frac valve with the first valve shifting tool and fracturing the second zone;

closing the second frac valve with the first valve shifting tool;

closing the formation isolation valve with a second valve shifting tool coupled to the service tool as the service tool is pulled out of the wellbore, wherein the formation isolation valve is positioned above the first and second frac valves;

opening the formation isolation valve with a third valve shifting tool coupled to a lower completion assembly as the lower completion assembly is run into the wellbore;

positioning the lower completion assembly at least partially within the liner such that a first flow control valve of the lower completion assembly is in fluid communication with the first frac valve, and a second flow control valve of the lower completion assembly is in fluid communication with the second frac valve;

positioning an upper completion assembly in the wellbore above the lower completion assembly;

opening the first and second flow control valves;

flowing a first fluid from the first zone through the first frac valve and first flow control valve and into an inner bore of the lower completion assembly; and flowing a second fluid from the second zone through the second frac valve and second flow control valve and into the inner bore of the lower completion assembly.

16. The method of claim 15, wherein the formation isolation valve prevents an axial flow through the liner assembly when in the closed position.

17. The method of claim 15, further comprising actuating the first and second frac valves into a filtering position with a fourth valve shifting tool coupled to the service tool.

18. The method of claim 15, further comprising actuating the first and second frac valves into a filtering position with a fourth valve shifting tool coupled to the lower completion assembly.

19. The method of claim 15, wherein the lower completion assembly and the upper completion assembly are run in the wellbore together.

* * * * *